US006981820B2

(12) United States Patent
Nelson

(10) Patent No.: US 6,981,820 B2
(45) Date of Patent: Jan. 3, 2006

(54) SCREED HEATING ARRANGEMENT

(75) Inventor: James J. Nelson, Stillwater, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 27 days.

(21) Appl. No.: 10/284,111

(22) Filed: Oct. 30, 2002

(65) Prior Publication Data

US 2004/0086336 A1 May 6, 2004

(51) Int. Cl.
*E01C 19/22* (2006.01)

(52) U.S. Cl. ..... 404/118

(58) Field of Classification Search ..... 404/118, 404/71, 79, 95, 77

See application file for complete search history.

(56) References Cited

U.S. PATENT DOCUMENTS

| | | | | |
|---|---|---|---|---|
| 3,986,783 | A | 10/1976 | Rowley et al. | |
| 4,175,885 | A | 11/1979 | Jeppson | |
| 4,319,856 | A | 3/1982 | Jeppson | |
| 4,407,605 | A | 10/1983 | Wirtgen | |
| 4,429,216 | A | 1/1984 | Brigham | |
| 4,507,015 | A | 3/1985 | Furukawa et al. | |
| 4,647,508 | A * | 3/1987 | Gazit et al. | 428/421 |
| 4,656,339 | A | 4/1987 | Grise | |
| 4,661,689 | A | 4/1987 | Harrison | |
| 4,714,374 | A | 12/1987 | Mihara | |
| 4,717,812 | A | 1/1988 | Makita | |
| 4,719,335 | A | 1/1988 | Batliwalla et al. | |
| 4,725,717 | A | 2/1988 | Harrison | |
| 4,765,772 | A | 8/1988 | Benedetti et al. | |
| 4,942,078 | A | 7/1990 | Newman et al. | |
| 5,004,895 | A | 4/1991 | Nishino et al. | |
| 5,096,331 | A | 3/1992 | Raymond | |
| 5,229,583 | A | 7/1993 | van Egmond et al. | |
| 5,259,693 | A | 11/1993 | Raymond | |
| 5,395,179 | A | 3/1995 | Kotani | |
| 5,470,945 | A * | 11/1995 | Markle et al. | 528/390 |
| 5,554,236 | A * | 9/1996 | Singles et al. | 156/52 |
| 6,124,580 | A | 9/2000 | Nottmeier et al. | |
| RE36,981 | E | 12/2000 | Birtchet | |
| 6,252,033 | B1 * | 6/2001 | Kweon et al. | 528/170 |
| 6,350,969 | B1 * | 2/2002 | Rothchild | 219/505 |
| 2001/0014212 | A1 | 8/2001 | Rutherford | |

FOREIGN PATENT DOCUMENTS

| | | |
|---|---|---|
| EP | 0 295 351 | 12/1988 |
| EP | 0 641 887 | 3/1995 |
| WO | WO 01/51713 A1 | 7/2001 |
| WO | WO 03/000995 A1 | 1/2003 |

* cited by examiner

*Primary Examiner*—Thomas B. Will
*Assistant Examiner*—Raymond W Addie
(74) *Attorney, Agent, or Firm*—Jeff A. Greene; Leill & McNeil

(57) ABSTRACT

A screed heating arrangement is provided for a screed assembly that is towed behind a paving machine. The screed heating arrangement includes at least one electric heater bonded to an upper surface of a screed plate.

12 Claims, 5 Drawing Sheets

SCREED HEATING ARRANGEMENT

TECHNICAL FIELD

The present invention relates to asphalt paving machines, and more particularly to an electrically heated screed arrangement.

BACKGROUND

The laying of asphalt paving material on road surfaces entails spreading paving material consisting of an aggregate filled bituminous mixture on a prepared roadbed. The paving material is spread while hot and is then compacted so that upon cooling a hardened pavement surface is formed. Conventional paving machines utilize a heavy assembly termed a "screed" that is drawn behind the paving machine. The screed includes a replaceable screed plate that is constructed of a suitable steel, to spread a smooth even layer of paving material on the prepared roadbed. The weight of the screed assembly aids to compress the paving material and perform initial compaction of the paving material layer. Screed assemblies can include vibratory mechanisms placed directly on the screed plate or separate vibratory tamper bars connected in tandem with the screed plate to aid in the initial compaction of the paving material.

To facilitate laying of the paving material, the screed is typically heated, to a temperature in the range of about 82° to 171° C. (180° to 340° F.). Heating the screed assists the paving material in flowing under the screed and reduces adhesion of the paving material to the screed. If the screed is not adequately heated, the bituminous mixture contacts the bottom of the screed and begins to harden, resulting in buildup of paving material and excessive drag.

Conventional screed assemblies are commonly heated by fossil fuel powered burners that heat the upper surface of the screed plate by the direct application of flame or hot exhaust gases. The use of fossil fuel burners to heat screeds has several drawbacks. Combustion of fossil fuels generates smoke that represents a source of environmental pollution, and also poses a poor working environment for the paving workers. Additionally, because the flames or exhaust gases of the burners actually contact the screed surface, warping may result. The contour of the screed determines the quality, evenness or smoothness of the paving material that is being laid down. Screeds are often flexed under extreme tensile loads during use to achieve desired crowning or other surface contours.

One alternate heating system that represents an improvement in the environmental drawbacks is disclosed in U.S. Pat. No. RE 36,981 issued Dec. 5, 2000 to Ralph Birtchet and assigned to Universal Screed Inc. This patent discloses the use of an elastomeric electrically powered heating pad assembly positioned on the upper surface of the screed with a layer of insulation placed on top of the heating pad assembly. Then, a heavy steel grid member is placed on top of the insulation to hold the heating pad assembly and the insulation in place. The elastomeric material is specifically defined in this patent as being silicone rubber which has poor resistance to tear and abrasion and poor to fair resistance to fluids such as oil, gasoline, and solvents. Additionally, the design requires loose components placed on top of one another to maintain full contact of the heating pad with the screed.

The present invention is directed to overcome one or more of the problems as set forth above.

SUMMARY OF THE INVENTION

In one aspect of the present invention a screed heating assembly used on an asphalt paving machine, comprising: a screed assembly having at least one screed plate connected thereto; and at least one heating pad assembly bonded directly to an upper surface of said screed plate.

In yet another aspect of the present invention a method of bonding an electric heater to an upper surface of a screed plate is provided. The method includes positioning a bonding material between the upper surface of the screed plate and the electric heater, applying heat to the electric heater, the bonding material and the screed plate, and melting said bonding material.

DETAILED DESCRIPTION

Figure 1:
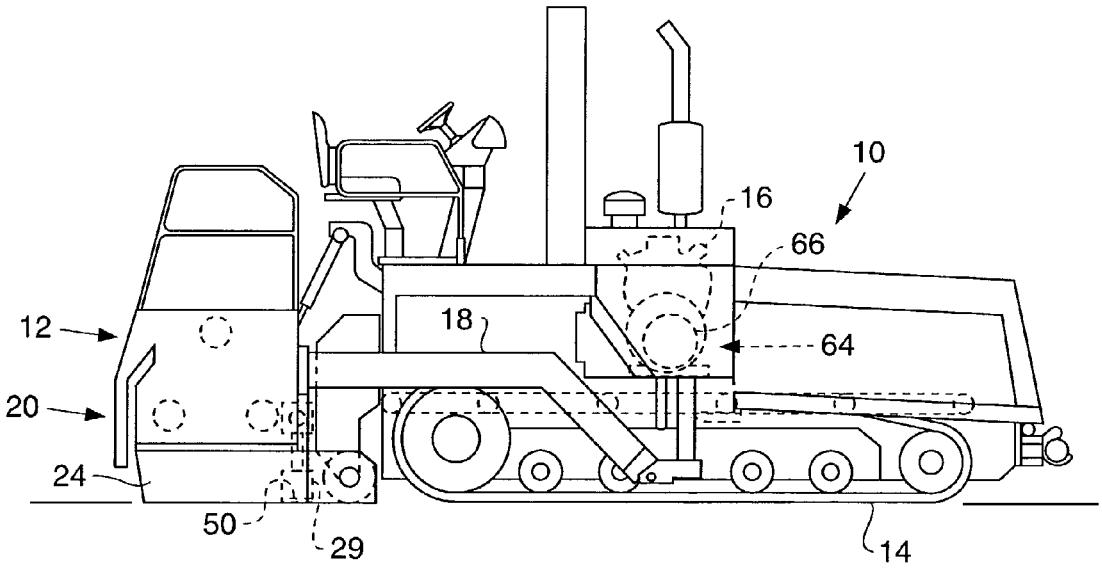
FIG. 1 is a diagrammatic side view of an asphalt paving machine towing a screed assembly embodying the present invention.

Referring to the drawings, specifically FIG. 1, an asphalt paving machine 10 is shown with a screed assembly 12 attached to the back thereof. The asphalt paving machine 10 is supported by a propelling arrangement 14 that is driven by an engine 16 in a conventional manner.

Figure 2:
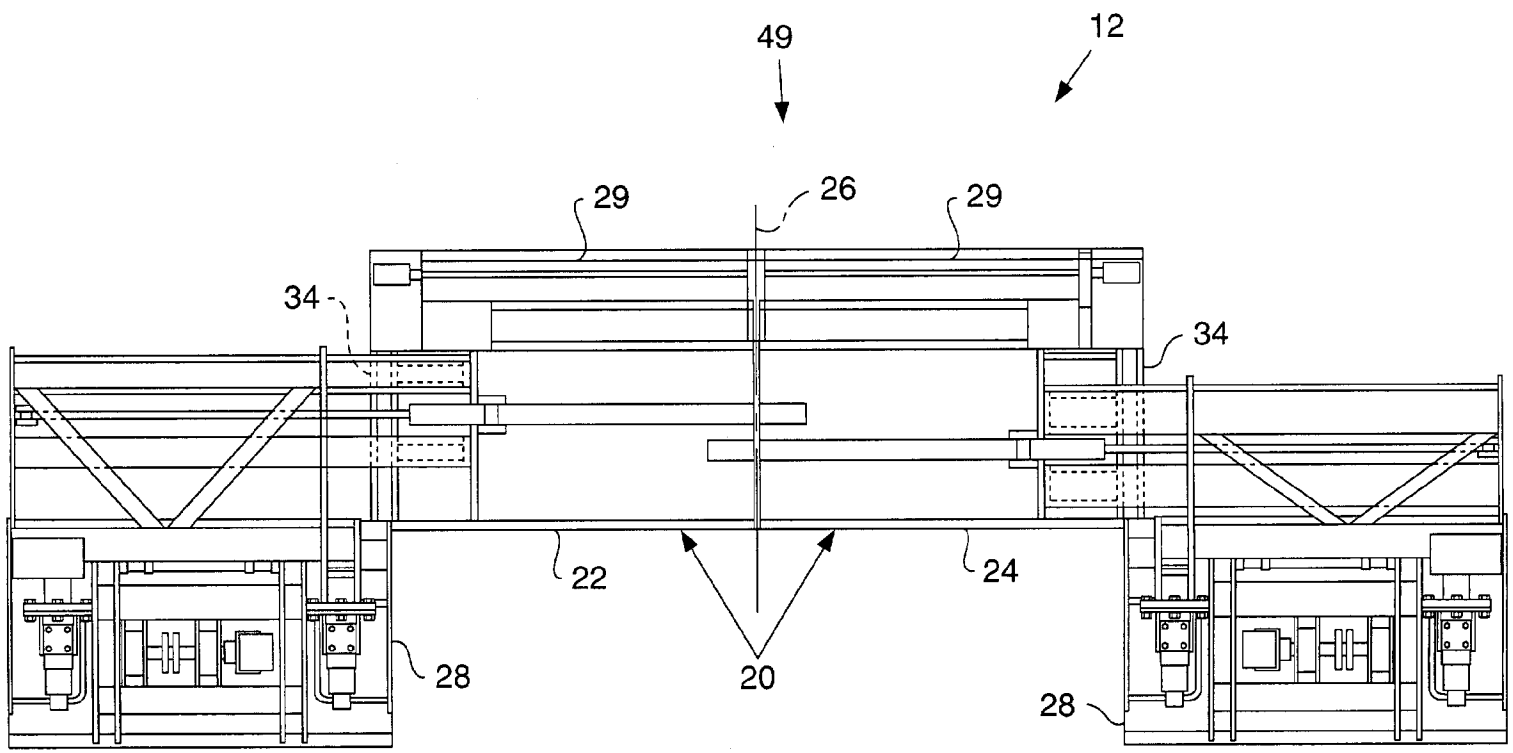
FIG. 2 is a plan view of the screed assembly shown in FIG. 1.

The screed assembly 12 is pivotally connected behind the asphalt paving machine 10 by tow arms 18. The screed assembly 12 may be any of a number of configurations such as a fixed width screed or a multiple section screed that includes extensions. As shown in FIG. 2, the screed assembly 12 is provided with a main screed section 20 with a left and a right screed section 22,24. The left and right screed sections 22,24 are hingably connected to one another along a longitudinal centerline 26 so that various operations, such as crowning, can be performed. A screed extension 28 is also provided behind and adjacent to both the left and right screed sections 22,24. It should also be understood that screed extensions 28 may be positioned in front of the main screed section 20 without departing from the gist of the present invention. Screed extensions 28 are slidably movable, such as by actuators (not shown), so that varying widths of paving material can be laid. The screed assembly 12 may also include a tamper bar arrangement 29 positioned forward of the main screed section 20, as shown in FIGS. 1 and 2. Alternatively, some screed assemblies 12 include a vibratory mechanism (not shown) positioned above the left and right screed sections 22,24 and the screed extensions 28 to aid in the initial compaction of the paving material being laid down.

Figure 3:
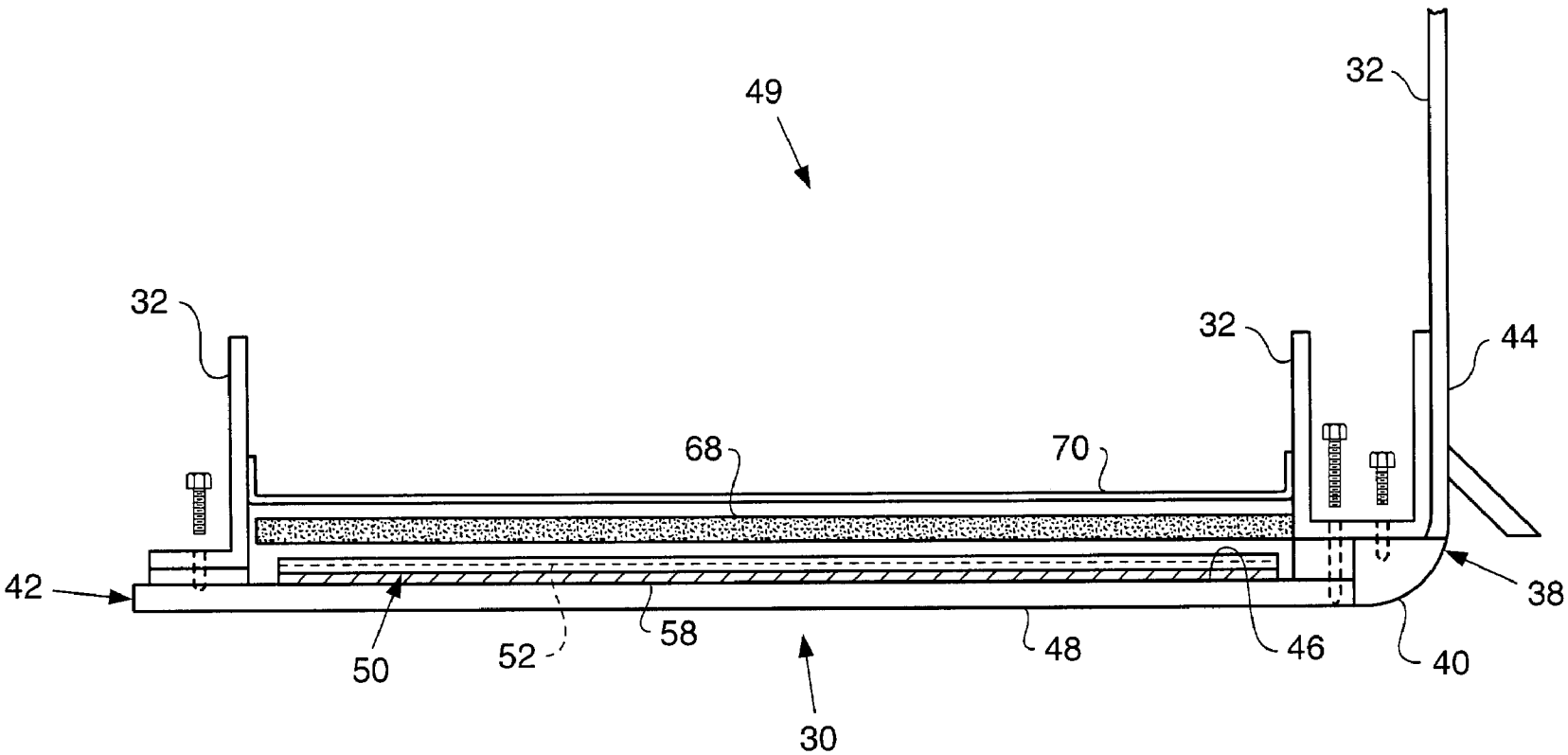
FIG. 3 is an enlarged partially exploded diagrammatic end view of the screed assembly of FIG. 2.

Referring now to FIGS. 2 and 3, each of the screed sections 22,24,28 include a screed plate 30 that is removably connected to and supported by a frame 32 that is reinforced by end plates 34. Screed plate 30 consists of an elongated flat metal plate that is connected to frame 32 as by fasteners. A forward leading edge 38 of the screed assembly 12 defines a radiused transition piece 40 that is fastened to the frame forward of the screed plate 30 with the screed plate 30 defining a rearward trailing edge 42. The radiused corner 40 blends into the forward portion of the frame 32 forming an upwardly extending face portion 44. As used herein throughout, "forward" refers to the portion of the screed assembly 12 that faces the asphalt paving machine 10, while "rearward" refers to the portion distal from the asphalt paving machine 10. In use, the screed assembly 12 is pulled in the forward direction behind the asphalt paving machine 10, so that the paving material is fed under the radiused corner 40. The screed plate 30 also defines an upper surface 46 and a lower surface 48 positioned between the leading edge 38 and the trailing edge 42.

Figure 4:
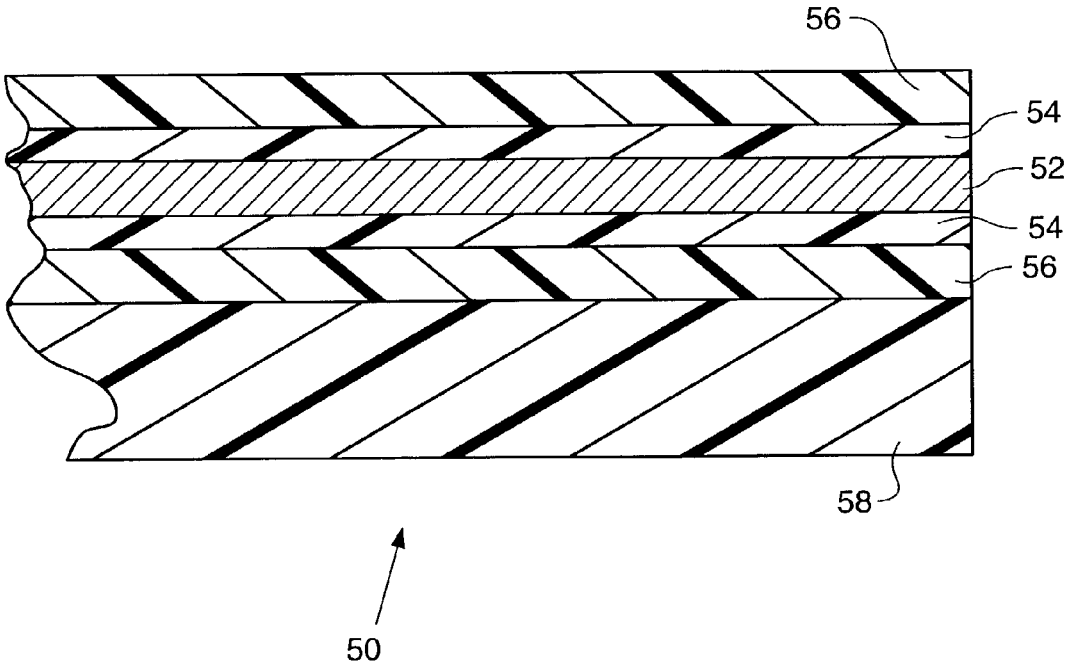
FIG. 4 is an enlarged section view of an electrical heater assembly of FIG. 3.

Now referring to FIGS. 3 and 4, each screed plate 30 is heated by a screed heating arrangement 49. The screed heating arrangement 49 has at least one electric heater 50 positioned on each screed plate 30. The electric heater 50 is configured as a thin, elongate sheet and formed from a resistive conductor 52, e.g., a thin conductive wire or ribbon sandwiched between a pair of bonding layers 54 and pair of outer layers 56. The pair of bonding layers 54 and the pair of outer layers 56 are for example thermoplastic films. For example, the bonding layers 54 are thin layers of a fluoropolymer film sold under the trade name TEFLON® FEP and the outer layers 56 are thin layers of a polyimide film sold under the trade name KAPTON®. The thickness of each electric heater 50 is in the range of about 101.6 $\mu$m (0.004 in) to about 355.6 $\mu$m (0.014 in). Preferably, the thickness of the heating pad assembly 50 is about 203.2 $\mu$m (0.008 in).

Figure 5:
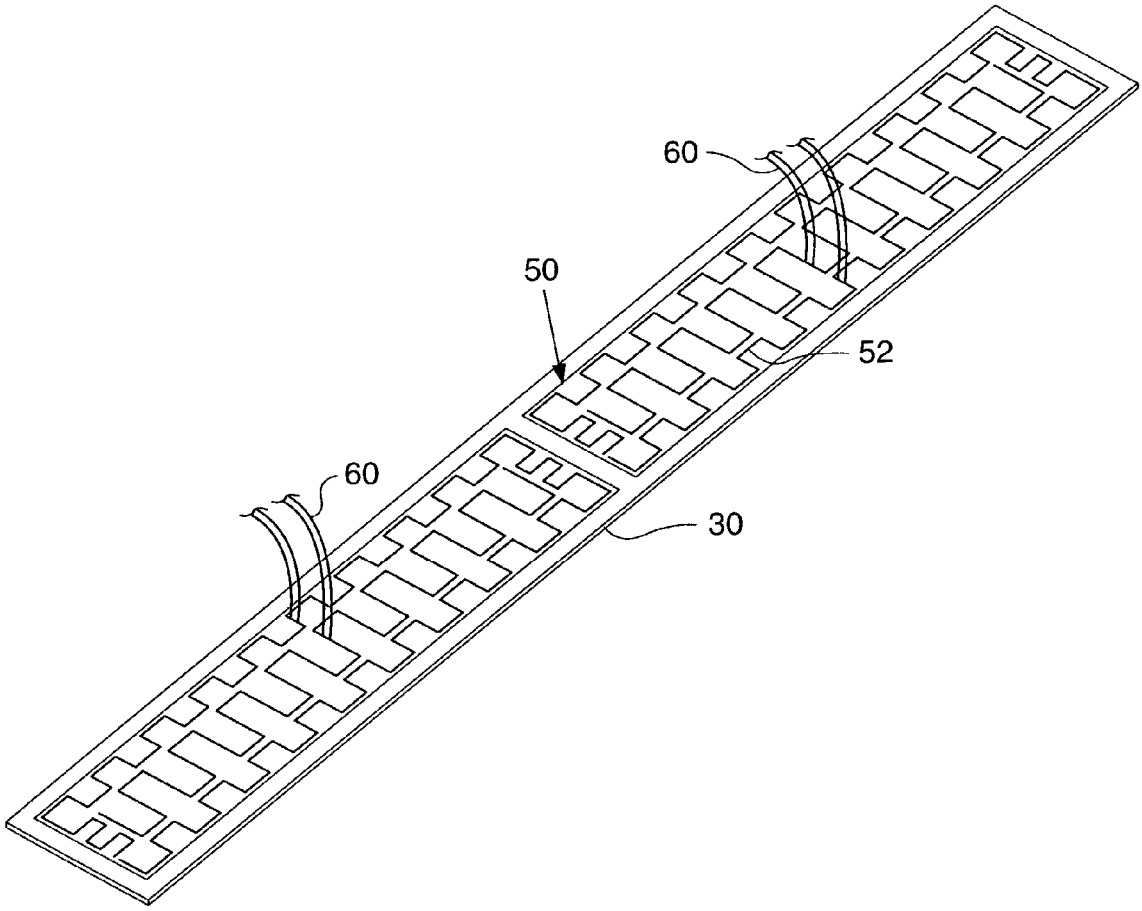
FIG. 5 is a perspective view of the electrical heater assembly of FIG. 3.

As shown in FIG. 3, the electric heater 50 is fixedly secured to the upper surface 36 of the screed plate 30 that is attached to the frame 32 of each screed section 22,24,28 by a bonding material 58. The bonding material 58 is for example a thin layer of a fluoropolymer film sold under the trade name TEFLON® FEP having a thickness in the range of about 25.4 $\mu$m (0.001 in) to about 203.2 $\mu$m (0.008 in). Preferably, the thickness of the bonding material 58 is about 76.2 $\mu$m (0.003 in) so that there is an adequate amount of the bonding material 58 to fill the porosities in the screed plate 30 and appropriately secure the electric heater 50 thereto. The bonding material 58 may alternately be an acrylic adhesive material or other suitable material that would have acceptable properties of securing the electric heater 50 and still be able to conduct heat to the screed plate 30. Thus, at least one electric heater 50 is bonded to each screed plate 30. Preferably, as shown in FIG. 5, the screed plate 30 (for both the left screed section 22 and the right screed section 24) has two electric heaters 50. The electric heaters 50 are laid end to end and are fixedly secured thereto. The screed plate 30 of the screed extensions 28 may only have one electric heater 50 fixedly secured thereto. It may also be desirable to have an electric heater 50 fixedly secured to each tamper bar 29 if such screed assembly 12 is equipped with a tamper bar 29. The length and number of each electric heater 50 varies depending on the length the screed plate 30 for each screed section 22,24,28. The width of each electric heater 50 however is slightly less than the width of the upper surface 36 of the screed plate 30 for either of the screed sections 22,24,28. The resistive conductor 52 within each electric heater 50 terminates with a set of leads or electrical conductors 60 that protrude from the electric heater 50, or as preferably shown in FIG. 5, there are two resistive conductors 52 that each terminate with a set of leads 60.

Each electric heater 50 is connected to an electric power supply 64, shown in FIG. 1. One suitable electric power supply 64 for the practice of the present invention is an electric generator 66, with the output connections of the electrical generator 66 being connected to the leads 60 of a corresponding electric heater 50. The electrical generator 66 is operatively connected to the engine 16 of the asphalt paving machine 10, such as by direct connection or powered by a hydraulic motor (not shown), that is in turn connected to a hydraulic system of the asphalt paving machine 10. The generator 66 may be either an AC or DC generator such as a 12 or 24 volt DC or 110 or 240 AC generator.

Referring again to FIG. 3, a layer of insulation material 68 is positioned to cover each electric heater 50 and is secured in place by a plurality of straps 70, to reduce loss of heat from the heating pad assemblies 50 and more effectively transfer the heat to the screed plates 30. Both the insulation material 68 and the plurality of straps 70 are shown in a non-contacting position in FIG. 3 to aid in understanding of the arrangement. The plurality of straps 70 are "U" shaped members formed from flat stock and are fastened to the frame 32 of the screed assembly 12.

INDUSTRIAL APPLICABILITY

The electric heater 50 is bonded to the screed plate by positioning a bonding material 58 between the electric heater 50 and the screed plate 30 and applying heat. The screed plate 30, the bonding material 58 and the heating pad assembly 50 are heated to a temperature of approximately 299° C. (570° F.) for a duration of about 10 minutes. At this temperature and length of time the bonding material 58 melts and the arrangement is subsequently allowed to cool. Thus securing the electric heater 50 to be fixedly secured to the screed plate 30.

Once bonded to the screed plate 30, the outer layers 56 of each electric heater 50 have several purposes. The outer layers 56 serve to surround the resistive conductor 52 and resist damage due to high temperatures while still conducting heat to the screed plate 30. The outer layers 56 are also able to stand up to fluids such as fuel oil, diesel fuel, oil and solvents that may come into contact with the electric heater 50. These fluids may leak from systems on the asphalt paving machine 10 or used to clean the screed assembly 12. Due to the fact that the electric heater 50 is extremely thin and bonded to the screed plate 30 allows it to flex with the screed plate 30 during operation.

During operation of the asphalt paving machine 10, the electric heater 50 flexes with the screed plate 30 as the paving machine 10 traverses the road bed were asphalt paving material is being laid. Due to the ultra thin design of the electric heater 50 and the thermoplastic bonding material 58 stresses are kept to a minimum. Heat may be applied to the screed plate 30 either continuously or intermittently, depending on ambient conditions, temperature of the paving material and the speed at which the paving machine 10 is operating. For intermittent operation, the supply of power to the electric heater 50 can be either manually, or automatically through the provision of a control system and sensors that monitor the temperature of the screed plate 30.

The configuration of the screed heating arrangement 49 of the present invention allows for rapid heating of the screed assembly 12 to operation temperature. Screed plates 30 are conventionally operated at temperatures ranging from 82° C. (180° F.) to 171° C. (340° F.). The entire screed assembly 12 (i.e., the main screed section 20 and the screed extensions 28) can be brought up to an operating temperature of 104° C. (220° F.) in about 30 minutes.

The screed heating arrangement 49 described above offers improvements that previous designs do not. For example, the stresses that are present with rigid heating elements or those induced due to the manner in which the heating element is attached to the screed plate are not present. The present design also offers an electrical heater 50 that has better wear and abrasion resistance and better resistance to industrial fluids and natural elements, such as, ultra violet and moisture than any previous design.

What is claimed is:

1. A screed heating arrangement used on an asphalt paving machine, comprising:

a screed assembly having at least one screed plate connected thereto; and at least one electric heater bonded directly to an upper surface of said screed plate, and said electric heater, which includes a resistive conductor between a pair of layers, has a thickness in the range of about 101.6 $\mu$m (0.004 in) to about 355.6 $\mu$m (0.014 in).

2. The screed heating arrangement of claim 1, wherein said electric heater is bonded directly to said screed plate by a bonding layer.

3. The screed heating arrangement of claim 2, wherein said bonding is performed by one of a heating process and a chemical adhesion process.

4. The screed heating arrangement of claim 2, wherein said bonding layer is a fluoropolymer film.

5. The screed heating arrangement of claim 1, wherein said electric heater has a thickness of about 203.2 $\mu$m (0.008 in).

6. The screed heating arrangement of claim 1, wherein said pair of layers includes a pair of polyimide layers.

7. The screed heating arrangement of claim 6, wherein said pair of polyimide layers are bonded to the resistive conductor.

8. The screed heating arrangement of claim 6, wherein the pair of polyimide layers are thermoplastic.

9. The screed heating arrangement of claim 1, including a layer of insulation disposed over said electric heater.

10. The screed heating arrangement of claim 9, wherein said layer of insulation is retained by a plurality of straps fastened to a frame of said screed assembly.

11. The screed heating arrangement of claim 1 wherein said electric heater is at least as flexible as said screed plate, and is operable to flex therewith.

12. The screed heating arrangement of claim 1 wherein said electric heater includes said resistive conductor surrounded by said pair of layers, which include a solvent resistant outer layer.

* * * * *